US006945830B2

(12) United States Patent
Copper et al.

(10) Patent No.: US 6,945,830 B2
(45) Date of Patent: Sep. 20, 2005

(54) CONNECTOR SYSTEM HAVING OPPOSING BIASING BEAM AND LANCE

(75) Inventors: Charles Dudley Copper, Harrisburg, PA (US); Bogdan Octav Ciocirlan, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/690,862

(22) Filed: Oct. 20, 2003

(65) Prior Publication Data

US 2005/0085139 A1 Apr. 21, 2005

(51) Int. Cl.[7] ..... H01R 11/22
(52) U.S. Cl. ..... 439/852; 439/748
(58) Field of Search ..... 439/852, 748, 439/746, 747, 848, 595, 878, 851, 850, 872

(56) References Cited

U.S. PATENT DOCUMENTS

| | | | | |
|---|---|---|---|---|
| 4,620,766 | A | 11/1986 | Leonard | |
| 4,701,004 | A | 10/1987 | Yohn | |
| 5,667,392 | A | 9/1997 | Kocher et al. | |
| 5,928,037 | A | 7/1999 | Jetter et al. | |
| 6,042,433 | A * | 3/2000 | Chen | 439/852 |
| 6,325,680 | B1 * | 12/2001 | Suzuki | 439/852 |
| 6,390,860 | B2 * | 5/2002 | Shirouzu et al. | 439/752.5 |

* cited by examiner

*Primary Examiner*—Alexander Gilman

(57) ABSTRACT

An electrical contact includes a body having a first wall and a second wall opposed to the first wall. A rigid lance is integrally formed with the first wall and projects away from the second wall, and a deflectable biasing beam is integrally formed with the second wall and extends away from the first wall in a direction opposite to the lance.

6 Claims, 6 Drawing Sheets

CONNECTOR SYSTEM HAVING OPPOSING BIASING BEAM AND LANCE

BACKGROUND OF THE INVENTION

The invention relates generally to electrical connector systems, and more particularly, to electrical contacts for pin and socket connector systems.

Most modern devices include a number of electrical components and associated electrical systems cooperatively functioning in response to operator instruction and input for operating the device. To allow the different components of electrical systems to communicate, and to allow different electrical systems to communicate with one another, electrical connectors are used to interconnect desired electrical components. While secure and reliable connection of electrical component and systems is desirable for all devices, in certain applications, such as, for example, automobiles, the connectors are subjected to demanding operating environments. For instance, an automotive connector must endure extreme operating temperatures, moisture, vibration, lubricants and engine additives, dust and debris during use. Maintaining adequate electrical connections in such a demanding environment is a challenge.

One type of commercially available electrical connector system for automobiles is produced by Tyco Electronics Germany GmbH and is known as a Micro Quadlok System™. The Micro Quadlok System includes an array of contacts inserted into a plastic housing. Each of the contacts is fabricated from a copper alloy and includes a stainless steel cover attached to the contact body and which forms a lance. The lance extends upward from the contact body and is deflected against the housing to produce a bias or retention force to maintain the contact in a desired position within the housing. This construction, however, has at least two disadvantages.

For example, the ability of the lance to provide an adequate retention force once the contact is installed into the housing is at least partially compromised by the need for the lance to deflect in order to initially insert the contact into the housing. Ease of compliance for installation of the contact and maintaining an adequate retention force, however, can be mutually exclusive goals. As the lance is made more compliant for easier installation, it generates less retention force, and as the lance is made more rigid to produce a greater retention force, it is less compliant for insertion into the housing.

Additionally, the stainless steel cover is separately manufactured and attached to the copper alloy contact during production of the connector system. Thus, the stainless steel helper adds manufacturing steps and associated costs to production of the connector system.

BRIEF DESCRIPTION OF THE INVENTION

In an exemplary embodiment, an electrical contact comprises a body having a first wall and a second wall opposed to the first wall. A rigid lance is integrally formed with the first wall and projects away from the second wall, and a deflectable biasing beam is integrally formed with the second wall and extends away from the first wall in a direction opposite to the lance.

Optionally, the first wall further comprises a contact beam extending towards the second wall. The body may also comprise a pair of opposed side walls positioned between the first and second side walls thereby forming a pin cavity, wherein, one of the pair of side walls comprises a contact beam extending into the pin cavity and the other of the side walls comprises an embossment extending into the pin cavity. The second wall may extend obliquely to the first wall and the side walls may be tapered along a lower edge thereof. The tapered side walls allow the insertion of the contact in a housing. The integrally formed lance and biasing beam in the contact body eliminates external latch components known in prior contact systems, and the contacts may be used in existing connector housings.

In another embodiment, a contact assembly is provided. The assembly comprises a body having a top wall, a bottom wall and at least one side wall. A rigid lance is integrally formed with the top wall and projects outward therefrom. A first contact beam extends outward from the top wall, and a second contact beam extends inwardly from the side wall. A deflectable biasing beam is integrally formed with the bottom wall and extends outward therefrom, and a contact pin is received in the body and is engaged by the first and second contact beams.

In still another embodiment, an electrical connector system is provided. The system comprises at least one housing comprising a longitudinal cavity, therein and an electrical contact situated within the contact cavity. One of the housing and the contact comprises opposed top and bottom walls, a rigid lance integrally formed with the top wall, and a deflectable biasing beam extending from the bottom wall. The lance is in abutting contact with a portion of the other of the housing and the contact, and the biasing beam contacts a portion of the other of the housing and the contact. The biasing beam provides a biasing retention force thereto to maintain the contact in position relative to the housing.

DETAILED DESCRIPTION OF THE INVENTION

Figure 1:
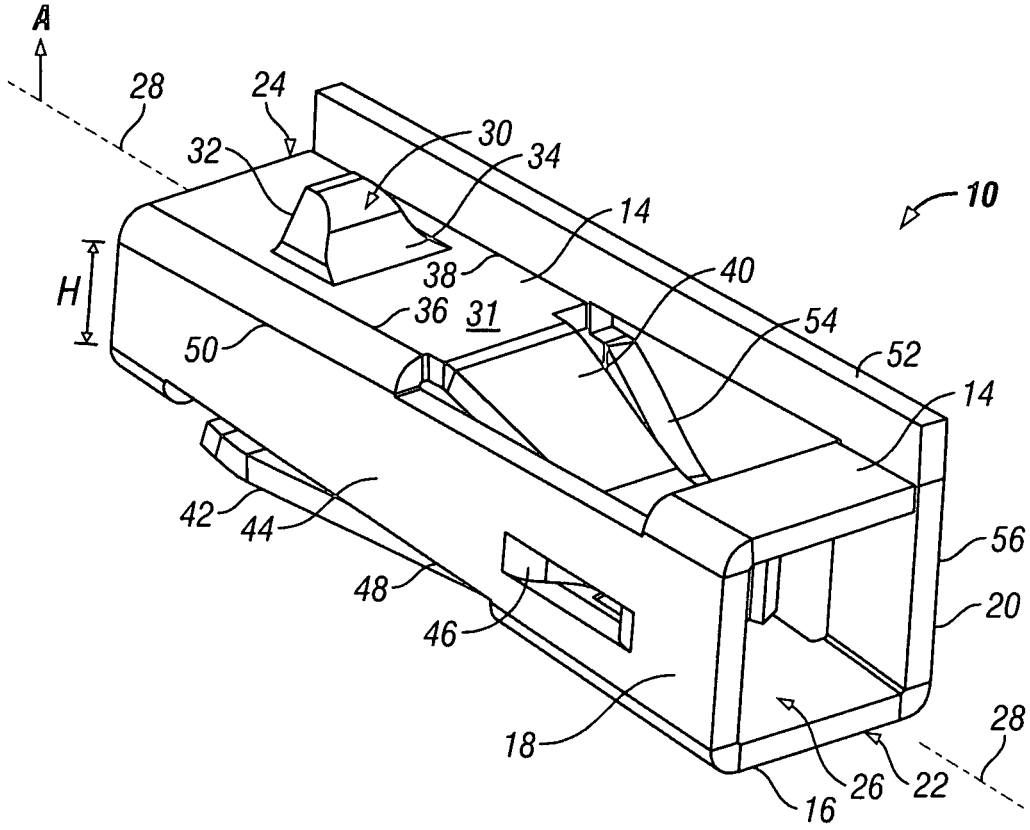
FIG. 1 is a top perspective view of a contact formed in accordance with an exemplary embodiment of the invention.

FIG. 1 is a top perspective view of an exemplary contact 10 which has been found particularly advantageous for connector systems for automotive use. In particular, and for the reasons explained below, the contact 10 is adapted for use with known automotive connector housings (not shown in FIG. 1) without making any modification to the housing or to terminal pins of a mating connector. Specifically, one embodiment of the contact 10 is adapted for use with housing and mating connectors of the aforementioned Micro Quadlok System. However, while the invention is described in the context of automotive connectors, it is appreciated that the benefits of the invention may accrue to electrical connectors generally in a wide variety of applications. The invention is therefore not intended to be limited to a particular end use or application, such as in an automotive connector system.

In an illustrative embodiment, and as shown in FIG. 1, the contact 10 includes a substantially rectangular body 12 which is includes a top wall 14, a bottom wall 16, and a pair of side walls 18 and 20 integrally formed with one another into the body 12. That is, the body 12 and each of the walls 14–20 are fabricated from a single piece of material. The top wall 14, bottom wall 16 and the side walls 18 and 20 collectively define a front end 22, a rear end 24, and an elongated contact cavity 26 extending therebetween. As will become apparent below, the front end 22 receives a mating contact pin (not shown in FIG. 1) of a mating connector (not shown in FIG. 1) which is inserted into the contact cavity 26 along a longitudinal axis 28 in a manner explained below.

In an exemplary embodiment, the contact 10 is fabricated from a sheet of copper alloy or other suitable conductive material and is formed or bent into the general shape and configuration illustrated in FIG. 1 according to known processes and techniques, including but not limited to stamping and punching operations. It is appreciated, however, that other methods of fabrication may be employed in further and/or alternative embodiments, including but not limited to molding processes and techniques.

In one embodiment the top wall 14 includes a deep drawn rigid lance 30 extending upward from a top surface 31 thereof and spaced a distance from the rear end 24. The rigid lance 30 includes a substantially flat leading face 32 and a curved or rounded face 34 opposite the leading face 32, although it is contemplated that a variety of alternatively shaped lances may be employed in various embodiments. The rigid lance 30 is approximately centered between lateral side edges 36 and 38 of the top wall 14, although it is appreciated that the rigid lance 30 could be otherwise positioned in another embodiment.

The top wall 14 further includes a top contact beam 40 which is spaced a longitudinal distance from the rigid lance 30 toward the front end 22. The top contact beam 40 extends downwardly from the top surface 31 toward the bottom wall 16 and into the contact cavity 26.

The bottom wall 16 is slightly angled or sloped relative to the longitudinal axis 28 and is also angled or sloped relative to the top wall 14 in an exemplary embodiment. The bottom wall 16 includes a deflectable biasing beam 42 extending therefrom, the construction and operation of which is explained in some detail below. The bottom wall 16 also includes an embossment (not shown in FIG. 1) projecting into the contact cavity 26 as described below.

The side wall 18 includes an outer surface 44 and an embossment 46 extending inward therefrom and into the contact cavity 26 proximate the front end 22 of the contact body 12. Additionally, the side wall 18 includes a lower edge 48 which is tapered relative to an upper edge 50 adjacent the top wall 14. In other words, the side wall 18 has a dimension H measured in a direction (indicated by arrow A) extending substantially perpendicular to the top wall 14 and substantially parallel to the outer surface 44 of the side wall 18. The dimension H decreases from the front end 22 toward the rear end 24. The side wall 20 similarly includes a tapered lower edge (not shown in FIG. 1). Collectively, the tapered side walls 18 and 20 facilitate insertion of the contact 10 into a housing (not shown in FIG. 1) by increasing a clearance of the biasing beam 42 with respect to the housing as the contact 10 is inserted therein. While tapering of the side walls 18 and 20 has been found to be advantageous in one embodiment, it is understood that the side walls need not be tapered in alternative embodiments.

In an exemplary embodiment, the side wall 20 includes a top edge 52 that extends beyond the top surface 31 of the top wall 14. The extension of the side wall 20 beyond the top surface 31 forms a guide surface for installing the contact 10 into the connector housing as further described below. Additionally, the side wall 20 includes a contact beam 54 extending inward from an outer surface 56 of the side wall 20 into the contact cavity 26. As will become evident below, the contact beam 40 of the top wall 14, the embossment 46 of the side wall 18, the embossment of the bottom wall 16, and the contact beam 54 of the side wall 20 form a four-sided receptacle for a pin of a mating connector.

Figure 2:
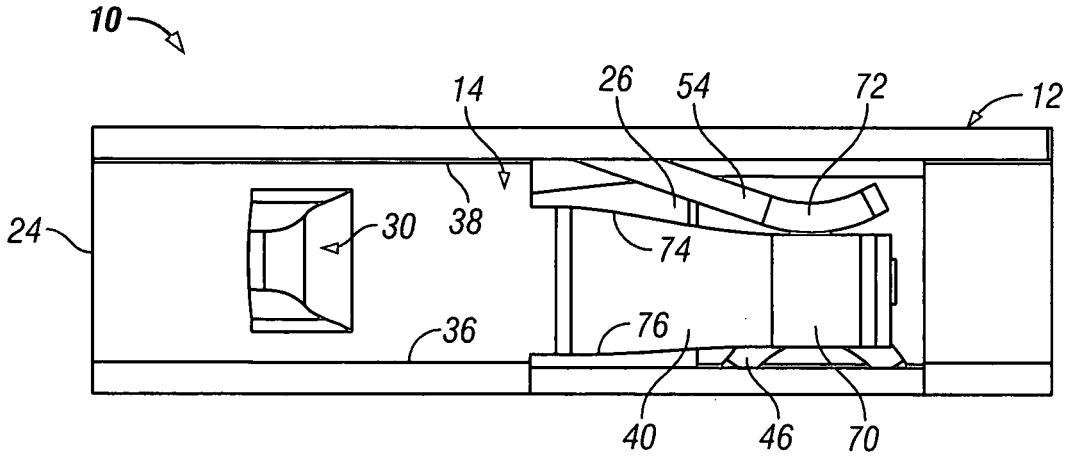
FIG. 2 is a top plan view of the contact shown in FIG. 1.

FIG. 2 is a top plan view of the contact 10 illustrating the contoured rigid lance 30 longitudinally spaced from the rear end 24 and substantially centered between the lateral side edges 36 and 38 of the top wall 14. The top contact beam 40 extends into the contact cavity 26 of the body 12 and includes a rounded contact point 70 on a distal end thereof. The contact beam 54 extends inward from the side wall 20 into the contact cavity 26 and includes a rounded contact point 72 on a distal end thereof, and the contact point 72 is positioned adjacent, but substantially perpendicular to, the contact point 70 of the top contact beam 40. The embossment 46 extends inward into the contact cavity 26 in an arched configuration adjacent the contact point 70 of the top contact beam 40. The top contact beam 40 is tapered on lateral side edges 74 and 76 to provide a clearance on either side thereof for deflection of the contact beam 40.

Figure 3:
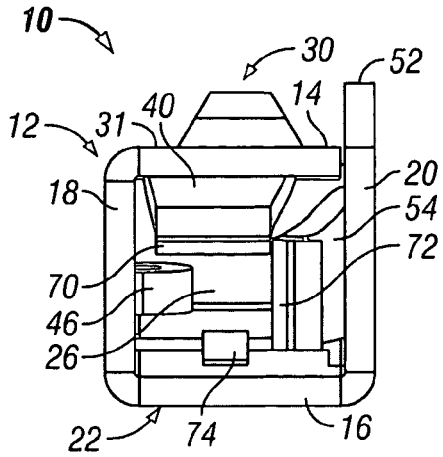
FIG. 3 is a front end view of the contact shown in FIGS. 1 and 2.

FIG. 3 illustrates the front end 22 of the contact 10 wherein the rigid lance 30 may be seen as extending upwardly from the top surface 31 of the top wall 14. The top edge 52 of the side wall 20 also extends above the top surface 31 of the top wall 14. The contact points 70 and 72 of the top contact beam 40 and the side contact beam 54, respectively, extend inwardly into the contact cavity 26 of the body 12 and form top and side contact surfaces, respectively, for receiving and engaging a contact pin (not shown in FIG. 3). The embossment 46 extends from the side wall 18 and forms a third contact surface for receiving and engaging the contact pin. An embossment 74 extends upwardly from the bottom wall 16 and forms a fourth contact surface for receiving and engaging the contact pin.

Figure 4:
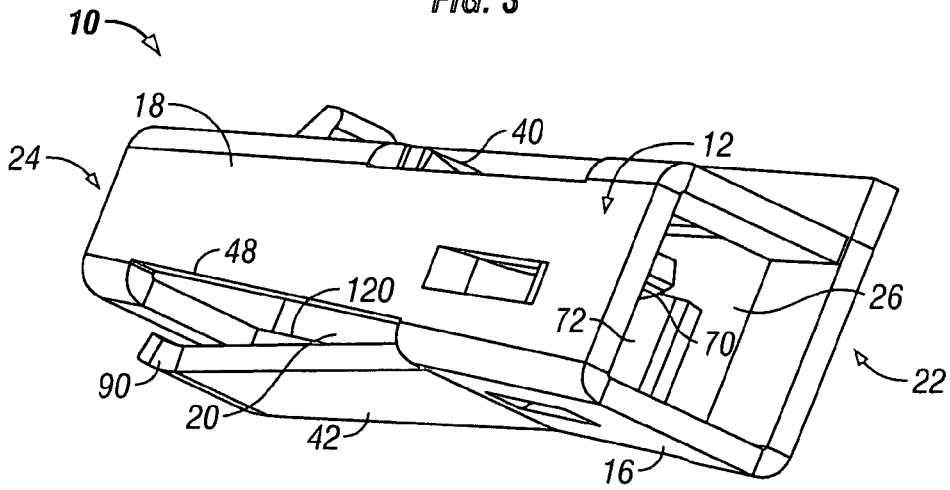
FIG. 4 is a first side perspective view of the contact shown in FIGS. 1–3.

FIG. 4 is a side perspective view of the contact 10 illustrating the biasing beam 42 extending away from the contact body 12 and at an angle. A curved tip 90 extends back towards the contact body 12 from the biasing beam 42 at a distal end thereof proximate the rear end 24. In an illustrative embodiment, the biasing beam 42 spans a substantial portion of the longitudinal distance between the front end 22 and the rear end 24. The contact points 70 and 72 of the top contact beam 40 and the side contact beam 54 (shown in FIG. 2), respectively, are extended toward a center of the contact cavity 26. Further, the lower edge 48 of the side wall 18 and a lower edge 120 of the side wall 20 are each tapered such that the profile of the side walls 18 and 20 decreases from the front end 22 toward the rear end 24.

Figure 5:
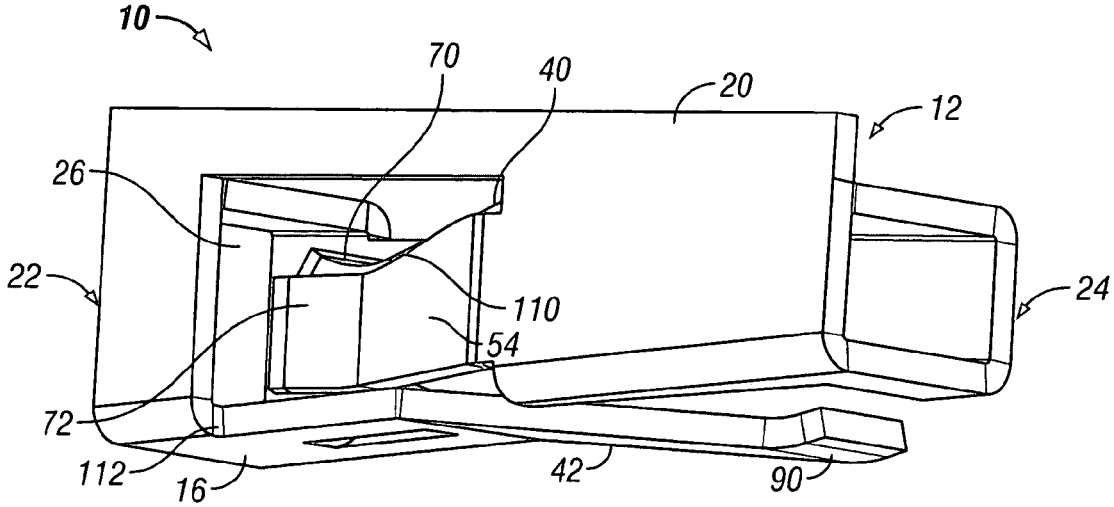
FIG. 5 is a second side perspective view of the contact shown in FIGS. 1–4.

FIG. 5 is a side perspective view of the contact 10 illustrating the contact beam 54 of the side wall 20 extending into the contact cavity 26. The top contact beam 40 also extends inwardly into the contact cavity 26 adjacent to and just above the side contact beam 54. The upper edge 110 of the contact beam 54 is tapered and contoured to follow the geometry of the top contact beam 40 and to avoid interference therebetween. The biasing beam 42 is coupled to the bottom wall 16 at a proximal end 112, and the proximal end 112 is located in the vicinity of the contact points 70, 72 of the top contact beam 40 and the side contact beam 54.

Figure 6:
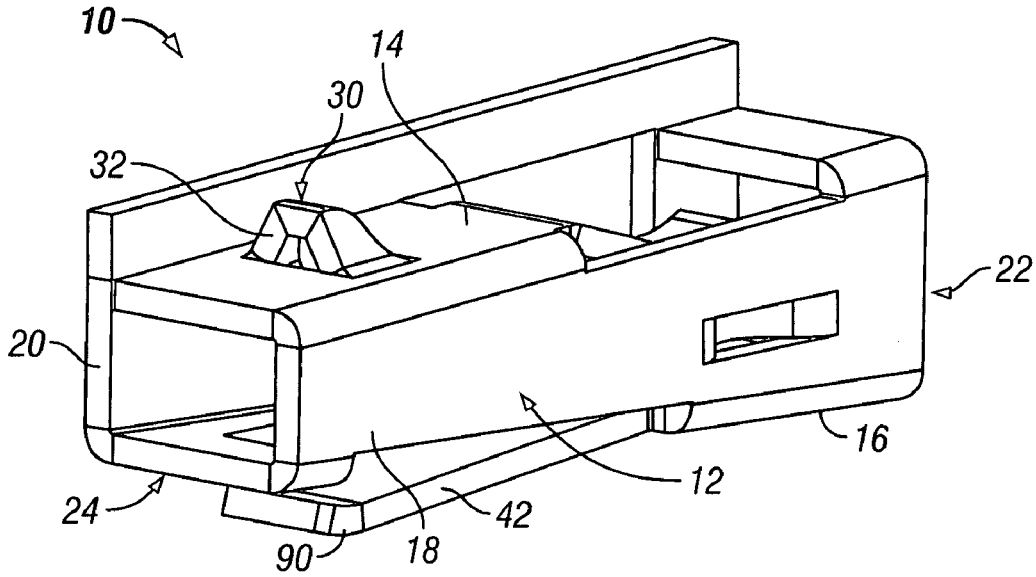
FIG. 6 is a rear perspective view of the contact shown in FIGS. 1–5.

FIG. 6 is a perspective view of the contact 10 from the rear end 24. The flat leading face 32 of the rigid lance 30 projects upward from the top wall 14 in a substantially perpendicular fashion. The rear end 24 the contact body 12 defines an open frame. The tapered side walls 18 and 20 provide a clearance for the biasing beam 42, with the biasing beam 42 extending beneath the side walls 18 and 20.

Figure 7:
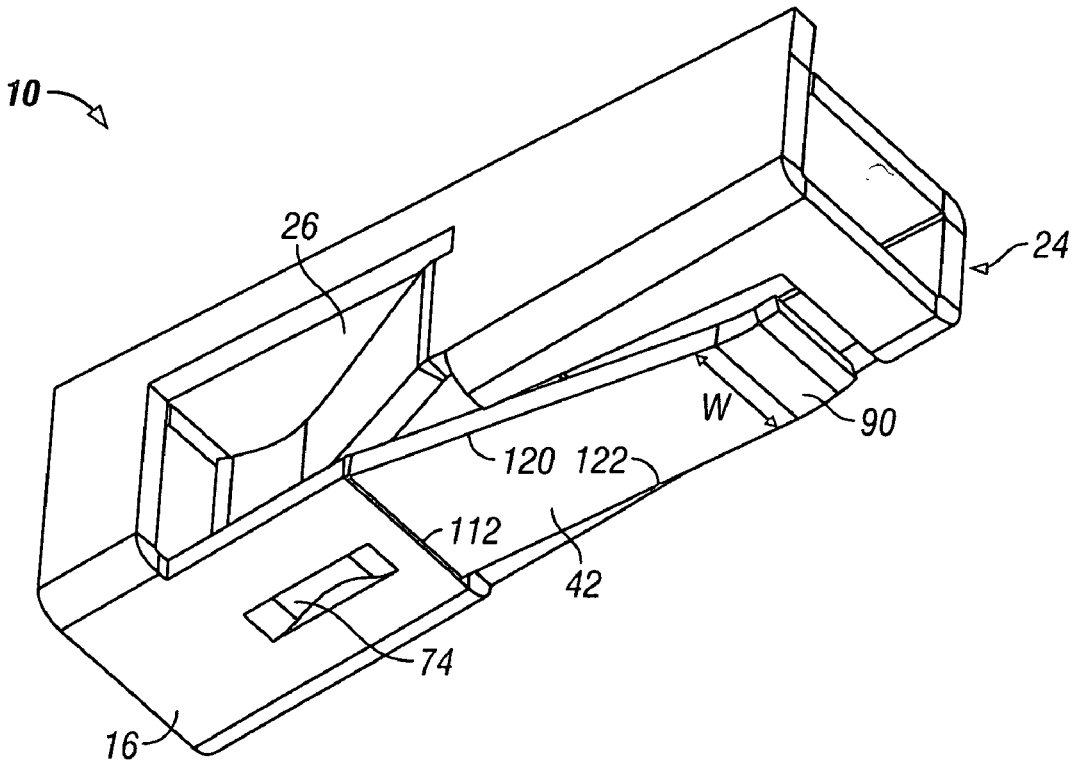
FIG. 7 is a bottom perspective view of the contact shown in FIGS. 1–6.

FIG. 7 is a bottom perspective view of the contact 10 illustrating the biasing beam 42 having tapered side edges 120 and 122 such that a lateral dimension W between the side edges 120 and 122 decreases from the proximal end 112 toward the tip 90. The embossment 74 extends upward from the bottom wall 16 and into the contact cavity 26 in an arched configuration.

Figure 8:
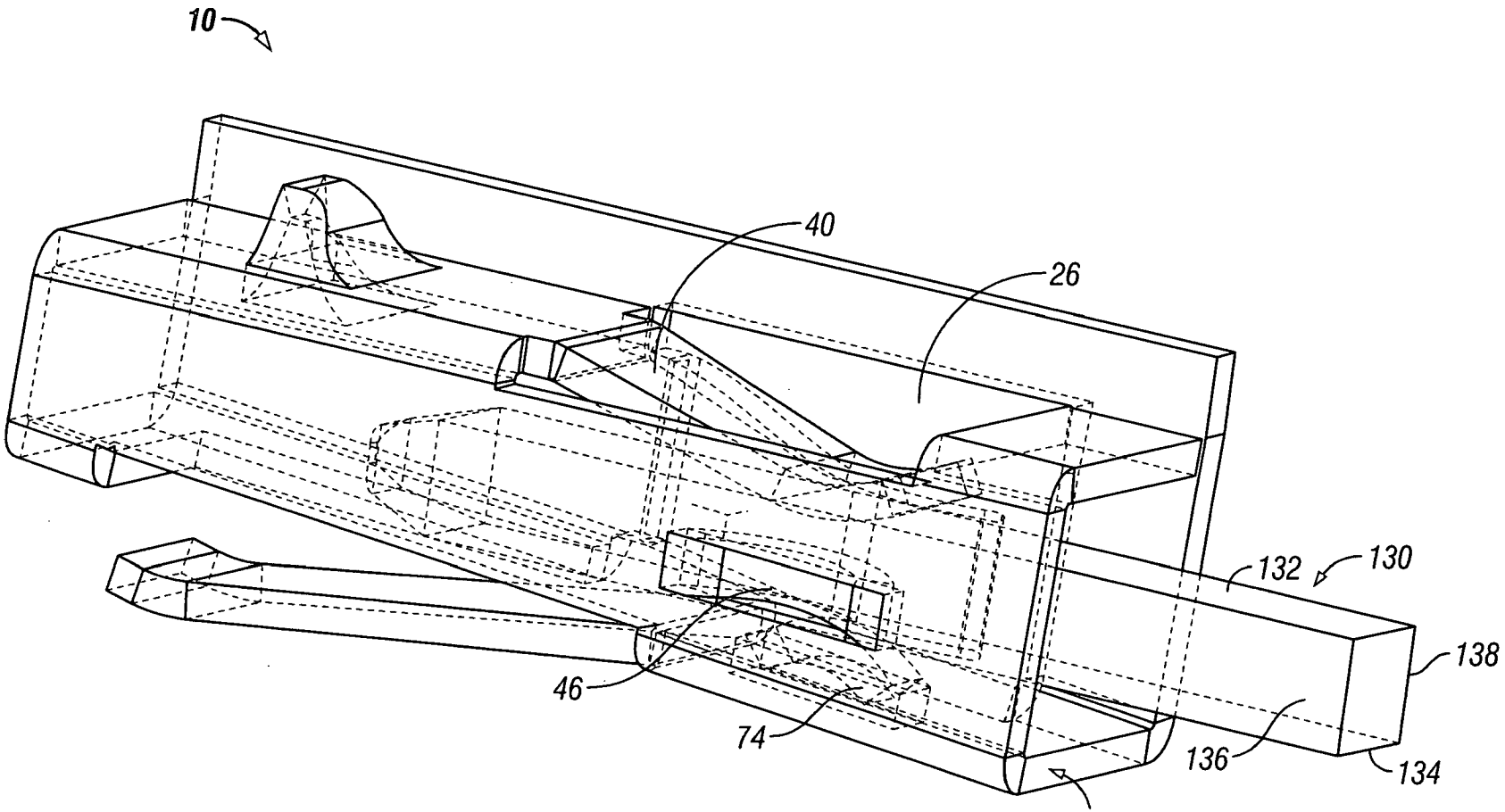
FIG. 8 is a side perspective view of the contact shown in FIGS. 1–7 engaged to a terminal pin.

FIG. 8 is a schematic view of the contact 10 engaged to a terminal pin contact 130 of a mating connector (not shown). In an exemplary embodiment, the pin contact 130 is a square post contact having opposed top and bottom surfaces 132 and 134, and opposed side surfaces 136 and 138. While a rectangular post contact 130 is illustrated in an exemplary embodiment, it is appreciated that other shapes of contact pins may likewise be employed in alternative embodiments.

In the illustrated embodiment, the pin contact 130 is inserted through the front end 22 of the contact 10 for a predetermined distance. Once inserted, the top contact beam 40 contacts the top surface 132 of the pin contact 130 and establishes electrical contact therewith. The embossments 46 and 74 contact the side surface 136 and the bottom surface 134, respectively, of the pin contact 130 and establishes electrical contact therewith, and the side contact beam 54 (shown in FIGS. 1–3 and 5–7) contacts the side surface 138 of the pin contact 130 and establishes electrical contact therewith when the contact pin 130 is inserted into the contact body 12. Electrical contact is therefore established on all four sides of the pin contact 130 for secure connection, and the rounded contact surfaces of the respective top contact beam 40, and the embossments 46 and 74 and the side contact beam 54 guide the contact pin 130 into proper alignment within the contact cavity 26.

Figure 9:
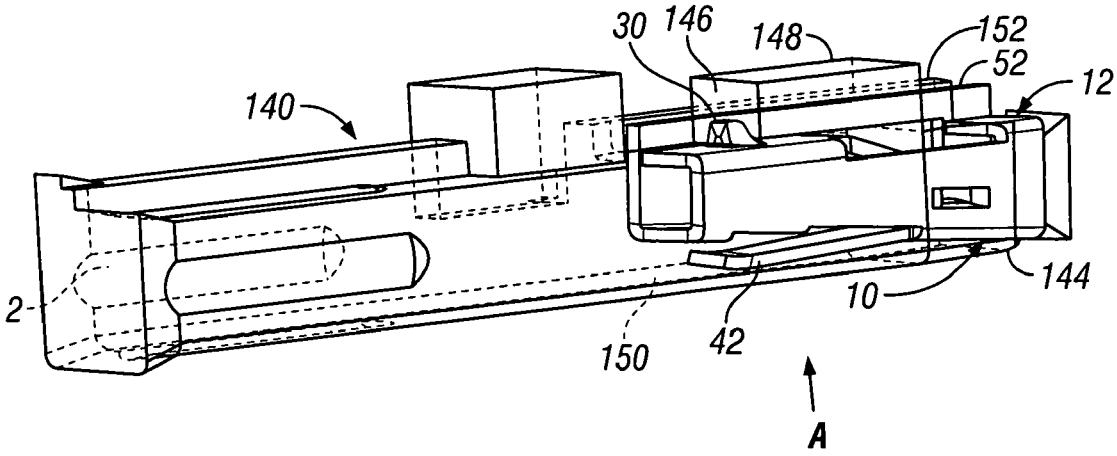
FIG. 9 is a side schematic view of the contact shown in FIGS. 1–7 inserted into a connector housing.

FIG. 9 is a side schematic view of the contact 10 situated in a terminal housing 140. The terminal housing 140 includes a substantially rectangular cavity in the form of a bore 142 extending therethrough. The cavity 142 is sized and dimensioned to receive the contact 10, and the contact 10 is located at one end 144 of the cavity 142. The rigid lance 30 is positioned against a stop wall 146 in an upper portion or retention area 148 of the housing 140, and the biasing beam 42 rests upon a bottom surface 150 of the housing 140. The biasing beam 42 is substantially in its relaxed position, and deflection of the biasing beam 42 as it is installed compresses the biasing beam 42 and generates a biasing force in the direction of arrow A to position the rigid lance 30 within the retention area 148. The contact 10 may be connected to a wire (not shown) within the housing via known crimping techniques.

The tapered profile of the contact 10 facilitates insertion of the contact 10 into the housing 140 without excessive deflection of the biasing beam 42. Therefore, the contact 10 may be installed rather easily.

The housing includes a rib 152 on one of the upper lateral sides which includes a groove that receives the top edge 52 of the contact body 12. The rib 152 provides a guide surface for proper installation of the contact 10 via a keying arrangement.

In one embodiment, the housing 140 is a known housing such as that commercially used in the Micro Quadlok™ system of Tyco Electronics. Thus, the contact 10 may be used with a known housing 140 without modification thereto. Additional costs of designing and producing a suitable housing for the contact 10 may therefore be avoided. In alternative embodiments, however, the contact 10 may be used with a differently configured housing without departing from the scope and spirit of the invention.

An integral contact 10 is therefore provided which is both easily installed and generates substantial retention force. Stainless steel covers for retaining known contacts in the housing may be eliminated, together with associated costs. Secure and reliable electrical connections are therefore provided at a lower cost and are compatible with existing connector housings. The increased retention force may more capably withstand a rugged vehicle environment, thereby improving performance and reliability of the connector and the associated vehicle or device.

Figure 10:
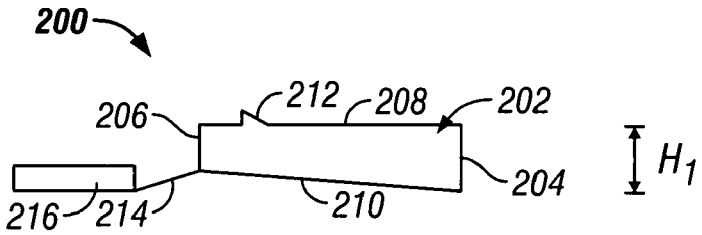
FIG. 10 is side plan view of a contact formed in accordance with an alternative embodiment of the invention.

According to an alternative embodiment, contact retention may be achieved through flexing of the contact, wholly or partially. For example, FIG. 10 is a side plan view of an exemplary contact 200 including a tapered contact body 202 having a first end 204 and a second end 206. The first end 204 has a first dimension $H_1$ between a top wall 208 and a bottom wall 210 of the contact body, and the dimension $H_1$ decreases from the first end 204 toward the second end 206 thereby providing a tapered profile of the contact body 202.

A rigid lance 212 projects upwardly from the top wall 208, and a biasing beam 214 extends from a leading edge of the second end 206 along a lower periphery thereof and at an angle with resect to the contact body 202. The biasing beam 214 is resiliently deflectable such that the angle of the biasing beam 214 with respect to the contact body 202 may be changed as the contact 200 is inserted into a housing (not shown in FIG. 10). A connector portion 216 extends from the biasing beam 214 on an opposite end from the contact body 202. A wire (not shown) may be connected to the connector portion 216, such as by a known crimping method.

Figure 11:
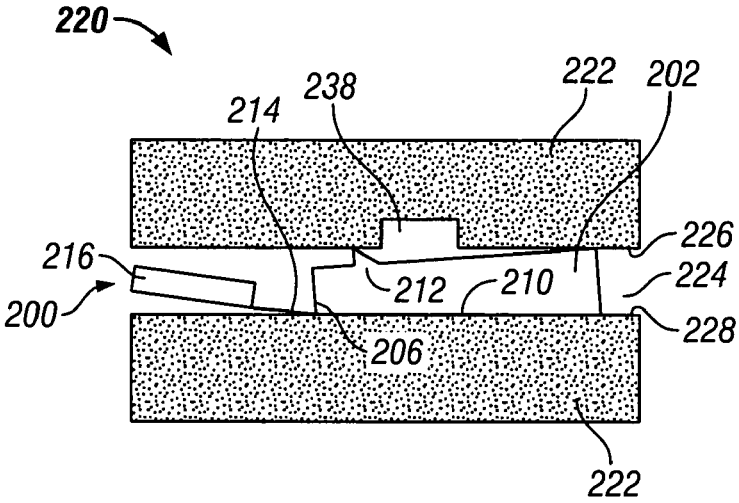
FIG. 11 is a side schematic view of a connector system including the contact shown in FIG. 10 situated within a housing in an unlatched position.

FIG. 11 is a side schematic view of a connector system 220 including a housing 222 forming a longitudinal cavity 224 having a top wall 226 and a bottom wall 228 opposite the first wall. The top wall 226 includes a recess or retention window 238 therein, while the bottom wall 228 is substantially smooth and continuous.

The contact 200 is inserted into the cavity 224, and the lance 212 is in sliding contact with the top wall 226 of the cavity 224, thereby flexing the biasing beam 214 towards the top wall 226 adjacent the second end 206 of the contact body 202. The bottom wall 210 of the contact 200 is positioned substantially flush with the bottom wall 228 of the cavity 224, and the connector portion 216 of the contact 200 is oriented obliquely to the bottom wall 228 of the cavity 224.

Figure 12:
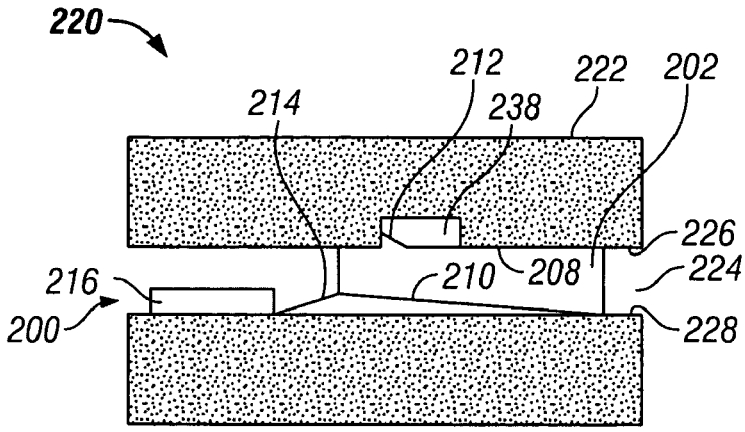
FIG. 12 is a side schematic view of the connector system shown in FIG. 12 in a latched position.

FIG. 12 is a side schematic view of the connector system 220 wherein the contact 200 is moved further into the longitudinal cavity 224 until the rigid lance 212 clears an edge of the retention window 238 and the resilience of the biasing beam 214 positions the contact body 202 in a position to retain the contact body 202 to the housing 222. The rigid lance 212 is positioned within the retention window 238 in the top wall 226 of the housing 222. The biasing beam 214 of the contact 200 is deflected back to its original position shown in FIG. 10 such that the top wall 208 of the contact 200 is substantially flush and parallel to the top wall 226 of the cavity 224 and the bottom wall 210 of the contact 200 is inclined with respect to the bottom wall 228 of the cavity 224. The connector portion 216 is substantially flush with the bottom 228 of the cavity 224.

Figure 13:
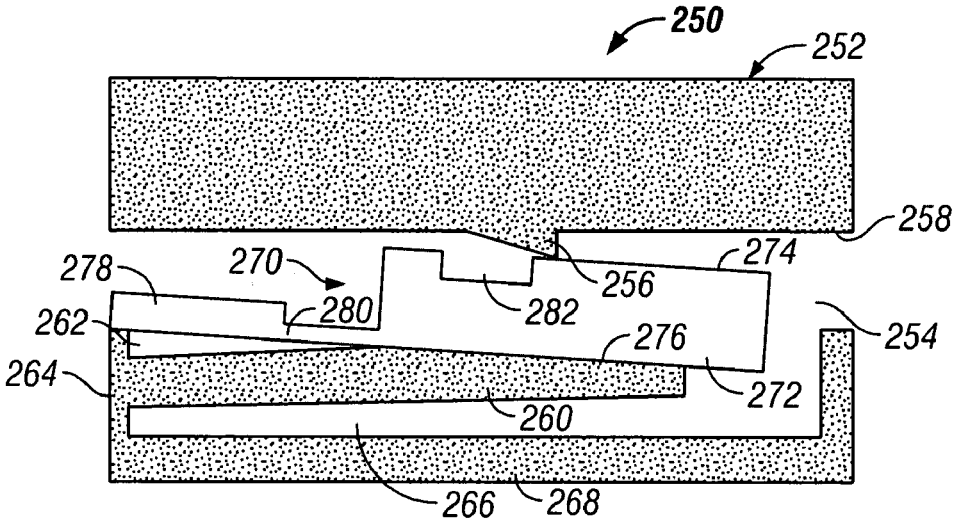
FIG. 13 is a side schematic view of a connector system in accordance with another exemplary embodiment of the invention in an unlatched position.

FIG. 13 is a side schematic view of another connector system 250 in accordance with another exemplary embodiment of the invention. The connector system 250 includes a housing 252 defining a longitudinal cavity 254 therein. A rigid lance 256 projects downwardly from a top wall 258 of the cavity 254, and a biasing beam 260 is formed in the housing 252 and defines a bottom wall 262 of the cavity 254. The biasing beam 260 is resiliently deflectable and fabricated from a known plastic material into a cantilevered beam extending from an end 264 of a lower portion of the housing 252. A gap or clearance 266 is provided between a bottom wall 268 of the housing 252 and the biasing beam 260 to permit deflection of the beam 260 downward toward the bottom wall 268 as a contact 270 is inserted into the cavity 254. As illustrated in FIG. 13, the biasing beam 260 is in a deflected position due to the lance 256 of the cavity 254 contacting the top wall 274 of the contact 270.

The contact 270 includes a contact body 272 having a top wall 274 and a bottom wall 276. A connector portion 278 extends from the contact body 272 with a rigid bridge portion 280 extending therebetween. A wire (not shown) may be connected to the connector portion 278, such as by a known crimping method. A recess or retention window 282 is provided in the top wall 274 of the contact body 272 for retaining the contact 270 to the housing 252 when the contact body 272 is properly positioned with respect to the rigid lance 256.

Figure 14:
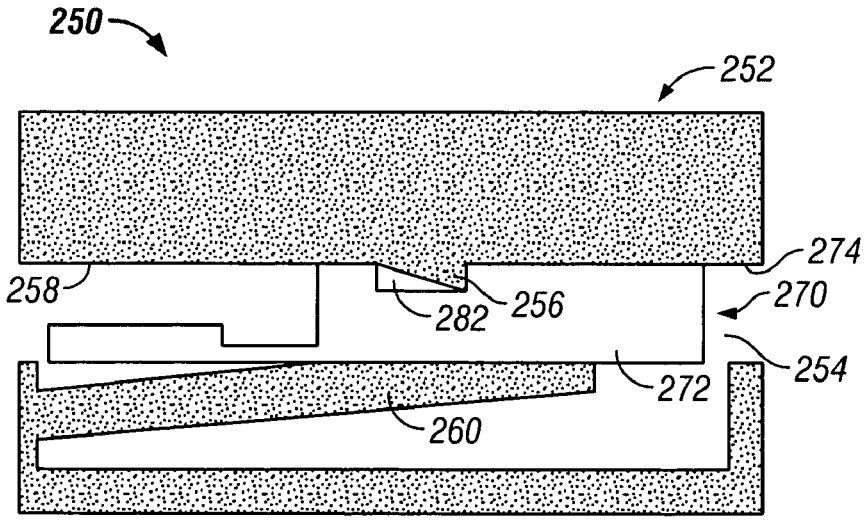
FIG. 14 is a side schematic view of the connector system of FIG. 13 in a latched position.

FIG. 14 illustrates the connector system 250 with the contact 270 in a retained position within the cavity 254. The rigid lance 256 is positioned with in the retention window 282 of the contact body 272 and the biasing beam 260 returns toward its natural, unflexed position to bias the contact body 272 against the top wall 274 of the housing 252.

Thus, unlike the embodiments described above, the lance 256 and the biasing beam 260 are formed in the housing 252 instead of the contact 270, while accomplishing substantially the same benefits and advantages.

While the invention has been described in terms of various specific embodiments, those skilled in the art will recognize that the invention can be practiced with modification within the spirit and scope of the claims.

What is claimed is:

1. An electrical contact comprising:

a body having a first wall and a second wall opposed to said first wall;

a rigid lance integrally formed with said first wall and projecting away from said second wall;

a deflectable biasing beam integrally formed with said second wall and extending away from said first wall in a direction opposite to said lance, said biasing beam being compressed when said contact is installed into a housing, thereby generating a retention force in a direction transverse to a longitudinal axis of said body and maintaining said lance in a predetermined position within the housing; and further comprising at least a third wall extending between said first wall and said second wall, said third wall tapered along a lower edge thereof adjacent said second wall.

2. An electrical contact comprising:

a body having a first wall and a second wall opposed to said first wall;

a rigid lance integrally formed with said first wall and protecting away from said second wall;

a deflectable biasing beam integrally formed with said second wall and extending way from said first wall in a direction opposite to said lance, said biasing beam being compressed when said contact is installed into a housing, thereby generating a retention force in a direction transverse to a longitudinal axis of said body and maintaining said lance in a predetermined position within the housing; and wherein said body comprises a pair of opposed side walls positioned between said first and second walls thereby forming a pin cavity, wherein one of said pair of side walls comprises a contact beam extending into said pin cavity.

3. An electrical contact in accordance with claim 2 wherein the other of said side walls comprises an embossment extending into said pin cavity.

4. An electrical connector system comprising:

at least one housing comprising a longitudinal cavity therein; and an electrical contact situated within said cavity;

wherein one of said housing and said contact comprises:

opposed top and bottom walls;

a rigid lance integrally formed with said top wall, said lance in abutting contact with a portion of the other of said housing and said contact;

a deflectable biasing beam extending from said bottom wall and engaging the other of said housing and said contact, a deflection of said biasing beam in a direction transverse to a longitudinal axis of said cavity providing a biasing retention farce directed toward said top wall to maintain said contact in position relative to said housing; and wherein said rigid lance is located on said housing, said contact comprising a retention window receiving said rigid lance.

5. A contact assembly comprising:

a body having a top wall, a bottom wall and at least one side wall;

a rigid lance integrally formed with said top wall and projecting upward therefrom;

a first contact beam extending downward from said top wall;

a second contact beam extending inwardly from said side wall;

a deflectable biasing beam integrally formed with said bottom wall and extending downward therefrom; and a contact pin received in said body and engaged by said first and second contact beams.

6. A contact assembly in accordance with claim 5 wherein said body is substantially rectangular.

* * * * *